US005224473A

United States Patent [19]

Bloomfield

[11] Patent Number: 5,224,473

[45] Date of Patent: Jul. 6, 1993

[54] RETROFITTING GAS MASK VOICE AMPLIFIER UNIT WITH EASILY ACTUATED SWITCH MEANS

[76] Inventor: John W. Bloomfield, 53 Outpost La., Hilton Head, S.C. 29928

[21] Appl. No.: 663,136

[22] Filed: Mar. 4, 1991

[51] Int. Cl.[5] ..... A62B 18/08; A62B 19/00; H04R 25/00

[52] U.S. Cl. ..... 128/201.19; 128/206.17; 381/169

[58] Field of Search ..... 128/201.19, 206.16, 128/206.17; 381/168, 169, 187, 188, 183, 75; 181/21, 22; 379/430; 2/422, 5

[56] References Cited

U.S. PATENT DOCUMENTS

| | | | |
|---|---|---|---|
| 3,180,333 | 4/1965 | Lewis | 128/201.19 |
| 3,218,607 | 11/1965 | Brock et al. | 128/201.19 |
| 3,314,424 | 4/1967 | Berman | 128/201.19 |
| 4,122,302 | 10/1978 | Bobb | 381/158 |
| 4,508,936 | 4/1985 | Ingalls | 381/79 |
| 4,683,588 | 7/1987 | Goldberg | 381/61 |
| 4,736,740 | 4/1988 | Parker et al. | 128/201.19 |
| 4,885,796 | 12/1989 | Loftus et al. | 381/187 |
| 4,901,356 | 2/1990 | Bauer | 381/169 |
| 4,980,926 | 12/1990 | Noetzel | 381/188 |
| 5,138,666 | 8/1992 | Bauer et al. | 128/201.19 |
| 5,159,641 | 10/1992 | Sopko et al. | 128/201.19 |

FOREIGN PATENT DOCUMENTS

| | | | |
|---|---|---|---|
| 9107859 | 5/1991 | World Int. Prop. O. | 381/169 |

*Primary Examiner*—Edgar S. Burr
*Assistant Examiner*—Kimberly L. Asher
*Attorney, Agent, or Firm*—Keck, Mahin & Cate

[57] ABSTRACT

An electrical amplifier unit which removably attaches to a gas mask and includes a microphone for detecting voice sounds emitted by the wearer of the gas mask, circuitry for amplifying the detecting sound, and a loudspeaker for emitting the amplified sounds externally of the mask. The associated components are contained within a housing which can be disassembled and which also contains a removable battery pack. The housing also is sealed from the external environment when completely assembled. The circuitry amplifies and filters the signals converted by the microphone and supplies a signal to the loudspeaker which is enhanced in the high frequency range but limited in the low frequency range so that the emitted voice sound is crisp and intelligible. The amplifier unit is attachable to some gas masks without additional hardware and to others with a removable adaptor. In either case, the amplifier unit does not affect the structural and functional integrity of the host mask.

13 Claims, 7 Drawing Sheets

RETROFITTING GAS MASK VOICE AMPLIFIER UNIT WITH EASILY ACTUATED SWITCH MEANS

BACKGROUND THE INVENTION

The present invention relates to a gas mask attachment and more particularly to a retrofitting gas mask voice amplifier unit.

Presently, in the event that chemical or bio-chemical weapons are used during military combat operations, troops in the region must immediately put on gas masks. The gas masks are sealed from the external environment so that the wearer does not inhale the contaminated air. In order for soldiers to communicate with other soldiers, a mechanical emitter (also referred to as a diaphragm) is provided on the gas mask. The diaphragm is sealed from the outside and vibrates according to the voice sounds of the wearer. The vibrations are translated into sound in the air outside of the gas mask.

However, the voice diaphragm has many deficiencies. Voice diaphragms greatly attenuate and distort voice information resulting in poor voice intelligibility and amplitude; the voice sound heard by other persons is garbled. In addition, the voice diaphragm increases fatigue on the part of the wearer attempting to compensate for the diaphragms limitations.

SUMMARY OF THE INVENTION

It is a primary object of the present invention to provide an electrical amplifier unit for attachment to a gas mask.

It is another object of the present invention to provide an electrical amplifier unit which attaches to a gas mask without affecting the structural and functional integrity of the gas mask.

It is a further object of the present invention to provide an electrical amplifier unit which quickly attaches and detaches from a gas mask to permit use of the gas mask without the amplifier unit immediately after removal.

It is still another object of the present invention to provide an electrical amplifier unit which attaches to a gas mask with minimal or no additional hardware.

It is another object of the present invention to provide a battery powered electrical amplifier unit attachable to a gas mask which has a power switch located internally but actuated externally to the unit.

It is yet another object of the present invention to provide a battery powered electrical amplifier unit attachable to a gas mask and which automatically disconnects power from its amplifier if no voice is detected by the unit for a preset period of time.

It is still a further object of the present invention to provide a battery powered electrical amplifier unit attachable to a gas mask and which has a removable battery pack designed to be easily replaced under exigent circumstances and in bad lighting conditions.

It is yet another object of the present invention to provide an adaptor which fits to a commonly used gas mask without affecting the structural and functional integrity of the mask and which permits attachment of an amplifier unit to the mask.

Briefly, the present invention is directed to an electrical amplifier unit having analog electronics for amplifying and filtering voice intelligence originating by mouth within the protected environment of a gas mask. The amplifier unit removably attaches to a gas mask and includes a housing supporting electronic amplifying and filtering circuitry, a loudspeaker and a removable battery pack for driving the circuitry and the loudspeaker. A power switch is positioned inside the housing but is actuated from a switch ring that is mounted external to the housing.

The housing of the unit comprises a hollow barrel member which has two isolated compartments each open at one end. The compartments are separated by a wall which has several small holes therein communicating between the compartments. In one compartment, a printed circuit board supporting the electronic circuitry and the loudspeaker are mounted. In the other compartment, an electret voice microphone and battery pack are mounted. The battery pack is removable from the barrel and has a recess therein for receiving a key in the barrel member so that the battery pack fits into the barrel member in only one orientation. Therefore, battery contact terminals on the battery pack are aligned properly with connection pins protruding from the printed circuit board and passing through holes in the wall separating the two compartments of the barrel member.

The external switch comprises a switch ring supporting a permanent bar magnet. The switch ring slides onto the barrel member and is rotatable about 30 degrees of circular rotation. At one extreme of rotation, the permanent bar magnet is aligned over a reed switch (disposed on the printed circuit board) inside the barrel member. When the permanent bar magnet is aligned with the reed switch, the reed switch closes and completes a circuit between the battery power supply and the power amplifiers of the electronic circuitry. Otherwise, with the ring rotated so as not to align the magnet with the read switch, the reed switch remains open disconnecting the power amplifiers from the battery power supply.

Furthermore, circuitry is provided for detecting the presence of voice and timing out if no voice is detected for a predetermined period of time. At the end of the predetermined period of time, with the switch ring still in the ON position, the battery power supply to the power amplifiers is disconnected, and will remain that way until a voice is again detected.

The amplifier unit may attach to many types of gas masks. To attach to a M-17 gas mask used by the United States armed forces, an adaptor is provided which removably fits onto the M-17 mask without harming the structural and functional integrity of the mask. The amplifier unit fits directly to a M-40 and M-CU/2P gas mask, which is soon to be issued to the United States armed forces.

The above and other objects and advantages will become more readily apparent when reference is made to the following description taken in conjunction with the accompanying drawings.

DETAILED DESCRIPTION OF THE DRAWINGS

Figure 1:
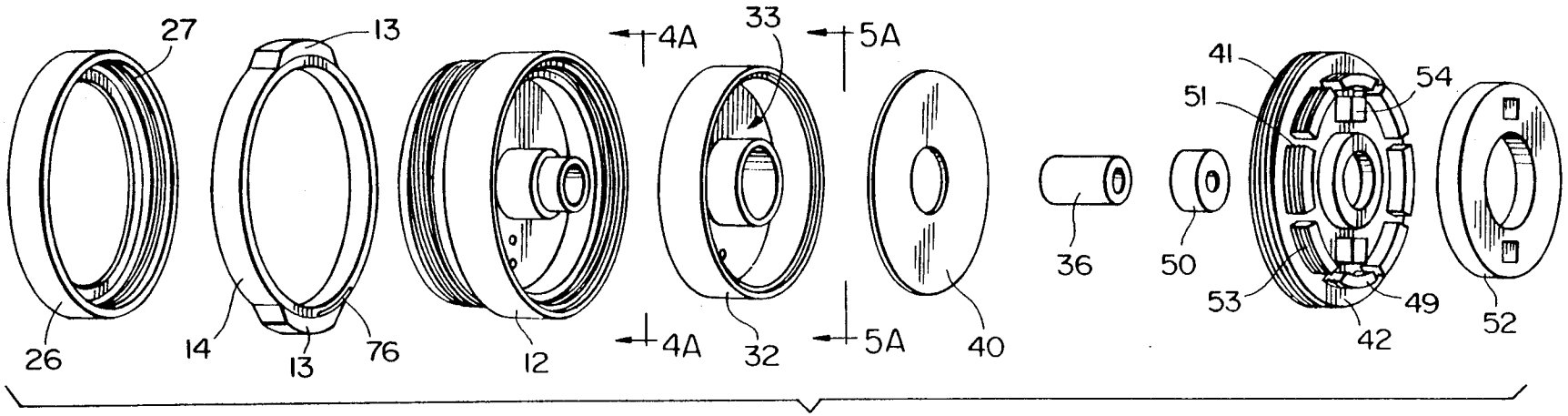
FIG. 1 is a perspective view of the unassembled retrofitting gas mask amplifier unit in accordance with the present invention and illustrating the main mechanical components thereof.
Figure 2:
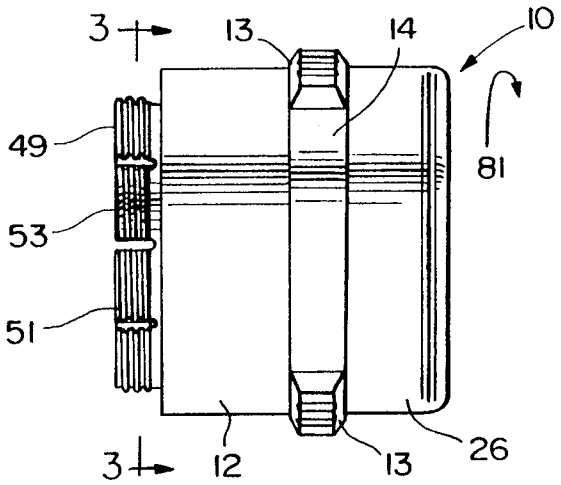
FIG. 2 is a perspective view of the retrofitting gas mask amplifier unit in assembled form.
Figure 3:
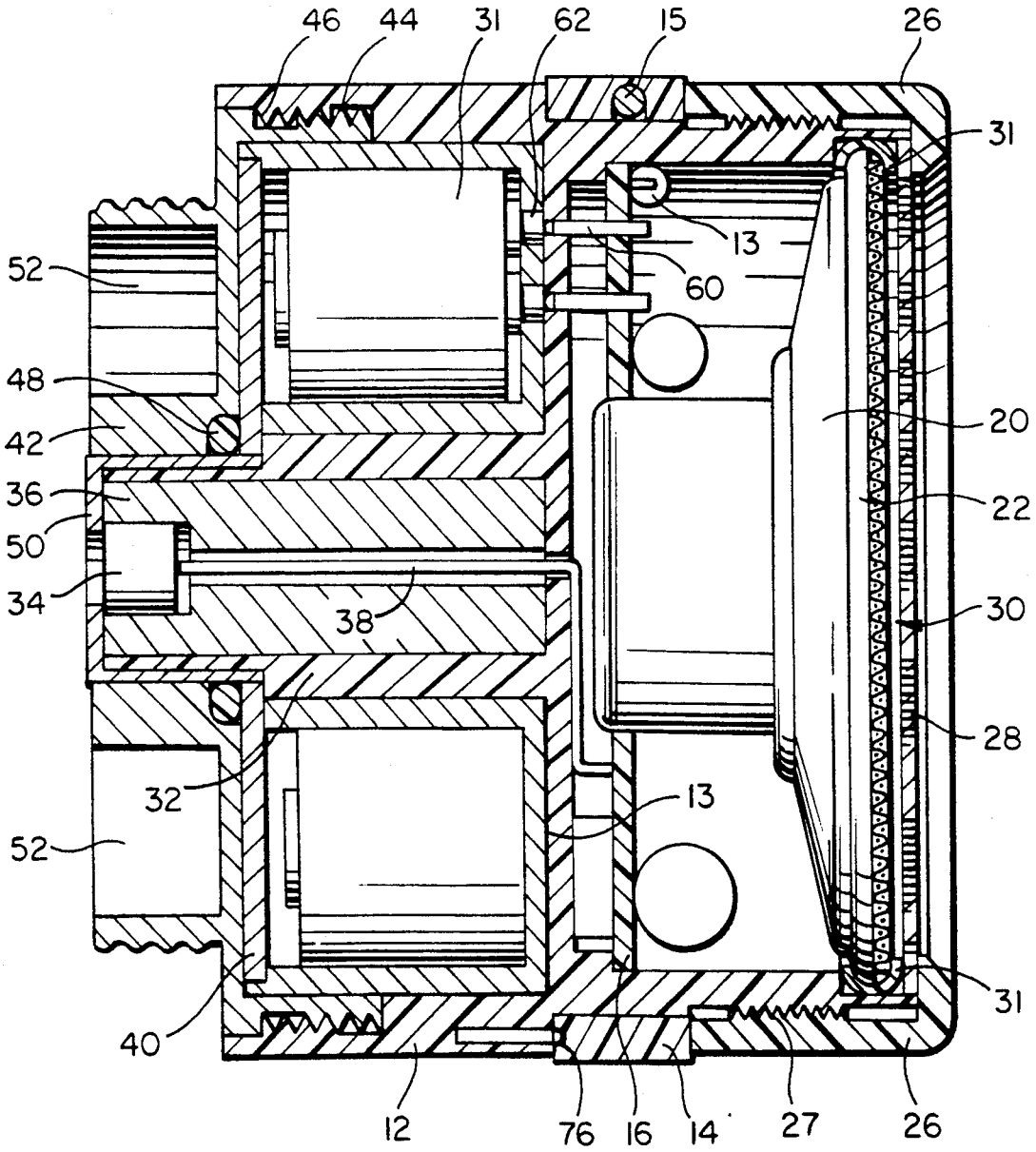
FIG. 3 is a cross-sectional view taken along line 3—3 of FIG. 2 corresponding to a central longitudinal axis of the amplifier unit.
Figure 4A:
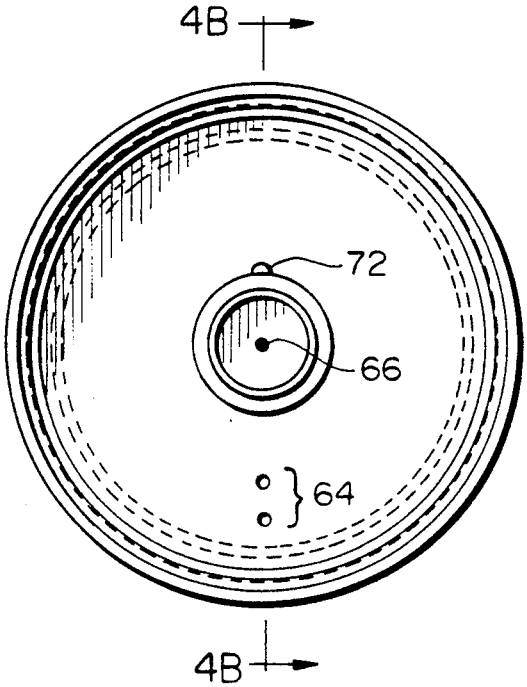
FIG. 4A is an end view as seen from line 4A—4A in FIG. 1.
Figure 4B:
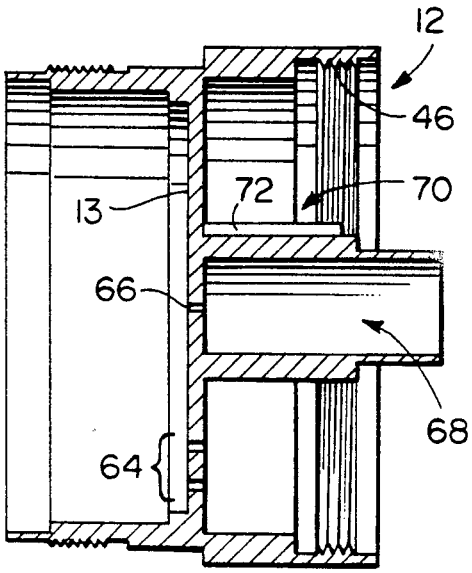
FIG. 4B is cross-sectional view taken through line 4B—4B in FIG. 4A.
Figure 5A:
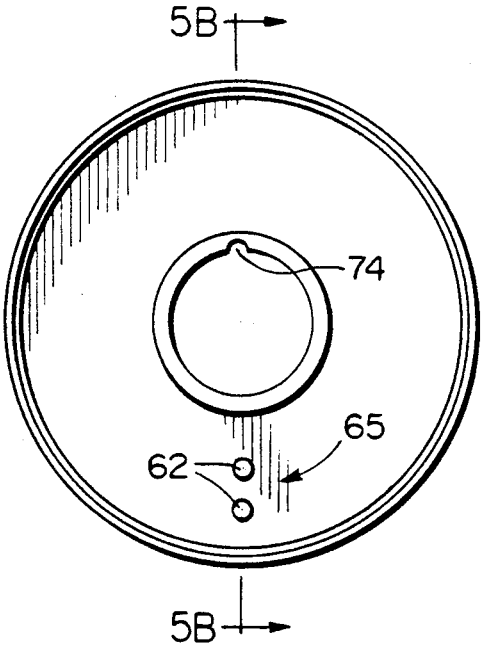
FIG. 5A is a an end view as seen from line 5A—5A in FIG. 1.
Figure 5B:
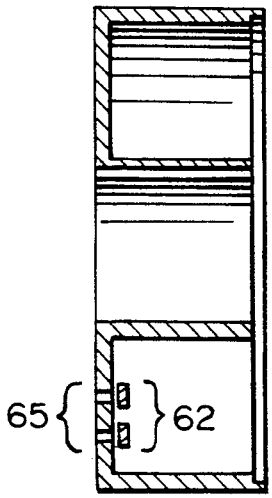
FIG. 5B is a cross-sectional view taken through line 5B—5B in FIG. 5A.

Referring first to FIGS. 1-3, the retrofitting gas mask amplifier unit is generally shown at 10. The gas mask amplifier unit 10 is designed to attach to a conventional gas mask to pick up voice sounds emitted by the mechanical emitter (otherwise known as diaphragm) forming a part of the gas mask.

A barrel 12 serves as the housing of the unit 10, is open at both ends and comprises two compartments separated by a retaining wall 13 formed as an integral part thereof. A switch ring 14 slides onto the barrel 12 and is rotatable about the barrel between ON and OFF positions to remotely actuate a reed switch 13 inside the barrel via a magnet 15, as will be described in more detail hereinafter. The switch ring 14 includes handle members 13 at diametric opposing positions on the ring.

In one compartment of the barrel, a printed circuit board 16 fits snugly inside the barrel 12 on a shelf created at a step in the barrel 12. Glue is used around the edges of the printed circuit board 16 to secure it inside the barrel 12. A speaker 20 is mounted inside the barrel 12 next to the printed circuit board 16 also on a shelf and is pressed fit to snugly mount in the barrel 12. The speaker 20 comprises a mylar cone vibration member 22 which produces the sound and also seals the speaker 20 and the contents of the barrel 12 from the outside. A dust or sand screen is mounted over the speaker 20 and the barrel 12 is closed at this end by the front cap 26 which screws onto threads 27 of the barrel 12. The sand screen comprises a grill 28 and screen material 30. Furthermore, a rubber gasket 31 is provided around the periphery of the speaker 20 to seal the speaker 20 in the barrel 12.

In the other compartment of the barrel 12, a battery casing 32 is inserted into the barrel 12 and contains a plurality of batteries 31 in a donut shaped well 33 of the battery casing 32 as will be explained in more detail hereinafter. The battery casing 32 is cylindrical and has a hollow passage in the center thereof which receives a microphone 34. A snap-in lid 40 is provided to close the battery casing 32 and is removable by wedging the lid 40 off the casing 32 from the center hole thereof.

The microphone 34 is contained in a cylinder of sound dampening foam 36 and connected by an insulated conductor 38 passing through the center of the foam 36 to the printed circuit board 16.

The barrel 12 is sealed at this end by a base 42 which has threads 44 that mate with threads 46 to screw into the barrel 12. The base 42 has a center passage into which the sound dampening foam 36 containing the microphone 34 is received. An O-ring 48 is provided in the center passage of the base 42 to seal the inside of the barrel 12. A microphone cap 50 is also provided in the center passage of the base 42 surrounding the outermost extreme portion of microphone 34. Finally, a disc of sound dampening foam 52 is attached to the base 42 and received by ring member 49 and the projections 54 on the base 42 to surround the microphone 34. The ring member 49 is provided with slots 51 and external threads 53, and serves to attach the amplifier unit to a gas mask, as will be explained in more detail hereinafter.

Electrical connections are made between the microphone and the printed circuit board 16 as well as between the battery casing 32 and the printed circuit board 16. The battery casing 32 is connected to the printed circuit board via internal battery connector pins 60 shown in FIG. 1 which are part of the printed circuit board and electrically connect to battery terminals 62 in the battery casing 32. In this regard, as shown in FIGS. 4A, 4B, 5A and 5B, the retaining wall 13 of the barrel 12 has two holes 64 which allow passage therethrough for the connector pins 60 and the battery casing 32 has holes 65 to provide access for the pins 60 to the battery terminals 62. In addition, the barrel 12 has a hole 66 to allow the insulated conductor 38 from the microphone 34 to connect with the printed circuit board 16.

Again, as shown in FIGS. 4A, 4B, 5A and 5B, in one compartment the barrel 12 comprises a cylindrical well 68 to receive the sound dampening foam 36 containing the microphone 34 (and its cap 50) and a donut-shaped well 70 to receive the battery casing 32. The battery casing 32 fits into the donut-shaped well 70 of the barrel 12 in only one orientation so that the connector pins 60 are aligned to make contact with the terminals 62 inside the battery casing 32. Specifically, the barrel 12 has a protrusion or key 72 on the wall of the cylindrical well 68 which fits into the groove 74 of the battery casing 32. Only the end of the battery casing 32 with the exposed battery terminals 62 will fit into the barrel 12. As a result, replacement of the power supply is made simple and precise under exigent circumstances and where lighting conditions are minimal. Also, in the other compartment of the barrel 12 a circular well 72 is provided to mount the printed circuit board 16 and the speaker 20, as previously described.

Several mechanical features have been designed in the structure described above to waterproof the internals of the unit. First, the speaker 20 comprises a mylar cone speaker member which is impervious to fresh or salt water. In addition, the rubber gasket 31 provides a water tight seal between the front face of the speaker and the remaining housing. Second, the base 42 holding the battery casing in place is screwed to the barrel 12 so that a waterproof barrier is provided between the exterior and the batteries. Also, the O-ring 48 prevents leakage into the battery casing 32 through the center of the battery lid 40.

Third, the microphone cap 50 is provided to protect the microphone 34. The cap 50 is made of tightly woven fabric which is plastic coated to prevent incidental capillary action and to preserve the water tight integrity of the microphone for several minutes when the unit is completely submersed in water. The microphone is an electret microphone which is made of a mylar layer of piezo film that is waterproof, as is common in electret microphones.

Next, electrical feedback between the relatively closely spaced speaker 20 and microphone 34 is minimized by the foam 52.

Finally, the ON/OFF power switch is internal to the protective housing of the unit and is actuated externally by the switch ring 14 which rotates about the exterior of the barrel over 30 degrees of rotation. As shown in FIG. 3, the switch ring 14 includes a small permanent bar magnet 15 mounted in a recess in the inner surface of the ring 14. A groove 76 is cut in the surface of the rim of the switch ring 14. The groove 76 extends around the ring approximately 30 degrees of a full 360 degree circle. The switch ring 14 slides onto the barrel 12 so that the groove 76 receives a protruding detent or stop 78 extending from the rim of the barrel 12. Rotating the switch ring 14 clockwise in the direction of arrow 81 shown in FIG. 2 to its furthest position (ON position) (as viewed from the front of the unit) will cause the magnet 15 to align over the reed switch 13 which in response closes to connect the battery power supply to the associated circuitry. Rotating the switch ring 14 counter-clockwise will move the magnet 15 out of alignment with the reed switch 13 (OFF position), thus opening the reed switch and disconnecting the circuitry from the battery power supply.

Many types of materials may be used to form the various structures of the gas mask attachment 10. However, it has been found that a plastic material called Noryl is preferred. Certain other structural features are provided to minimize exposure to chemical or biological contamination. The front cap 26 is removable to permit wiping of the mylar cone of the speaker 20 which may have been exposed to contaminates. The sound absorbing foam 36 and 52 is preferred to be non-absorbent to all known chemical/biological warfare agents. Otherwise, the foam may be a type which is removed and replaced periodically.

Several types of battery packs may be used with the unit. Generally, however, the circuitry requires 10.5 V DC to 12 V DC for operation. A first type of battery pack is a 9.6 V nickel-cadmium rechargeable battery which comprises eight 1.2 V rechargeable batteries. This battery pack is particularly useful for training situations where the unit may be used on a near-continuous basis and where the cost of supplying non-rechargeable battery packs would prove prohibited. The 9.6 V nickel-cadmium rechargeable battery pack can be recharged up to 500 times before replacement becomes necessary. It may be recharged using a manufacturer—supplied battery pack charger which may run off standard 110 V AC 50/60 Hz line current or 24 V DC vehicular battery source.

Alternatively, a 10.5 V DC alkaline battery pack may be used. This battery pack comprises seven 1.5 V batteries and is useful for cost-conscious situations in benign or non-critical environments where the unit is not subjected to extremes of temperature. This pack delivers has a longer lifetime than the nickel-cadmium cell but cannot be recharged.

Yet another alternative is a 12 V DC Lithium battery pack. This battery pack delivers the longest battery lifetimes of all three packs, extremely long shelf life, and will operate at extremes of temperatures that neither nickel-cadmium nor alkaline packs can match.

All three types of battery packs fit into the donut shaped well 33 of the battery casing 32 which in turn fits into the rear of the unit 10. The battery pack, when properly sealed to its companion unit, can be chemically decontaminated by immersion into any water-based decontamination solution. The plurality of batteries in the pack are electrically connected by soldering or other connections.

Figure 6:
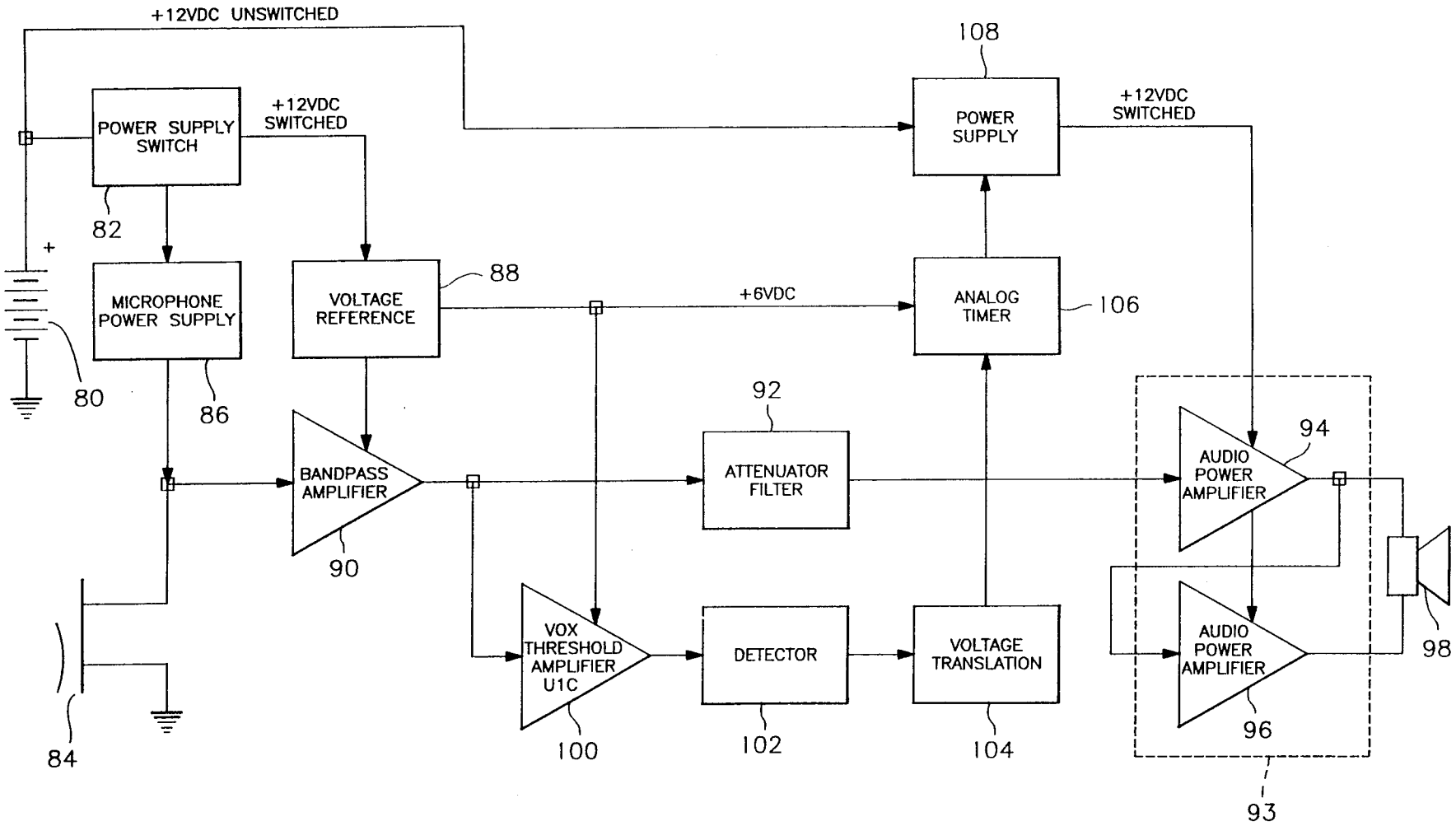
FIG. 6 is a block diagram of the electronic circuitry in the gas mask amplifier unit.
Figure 7:
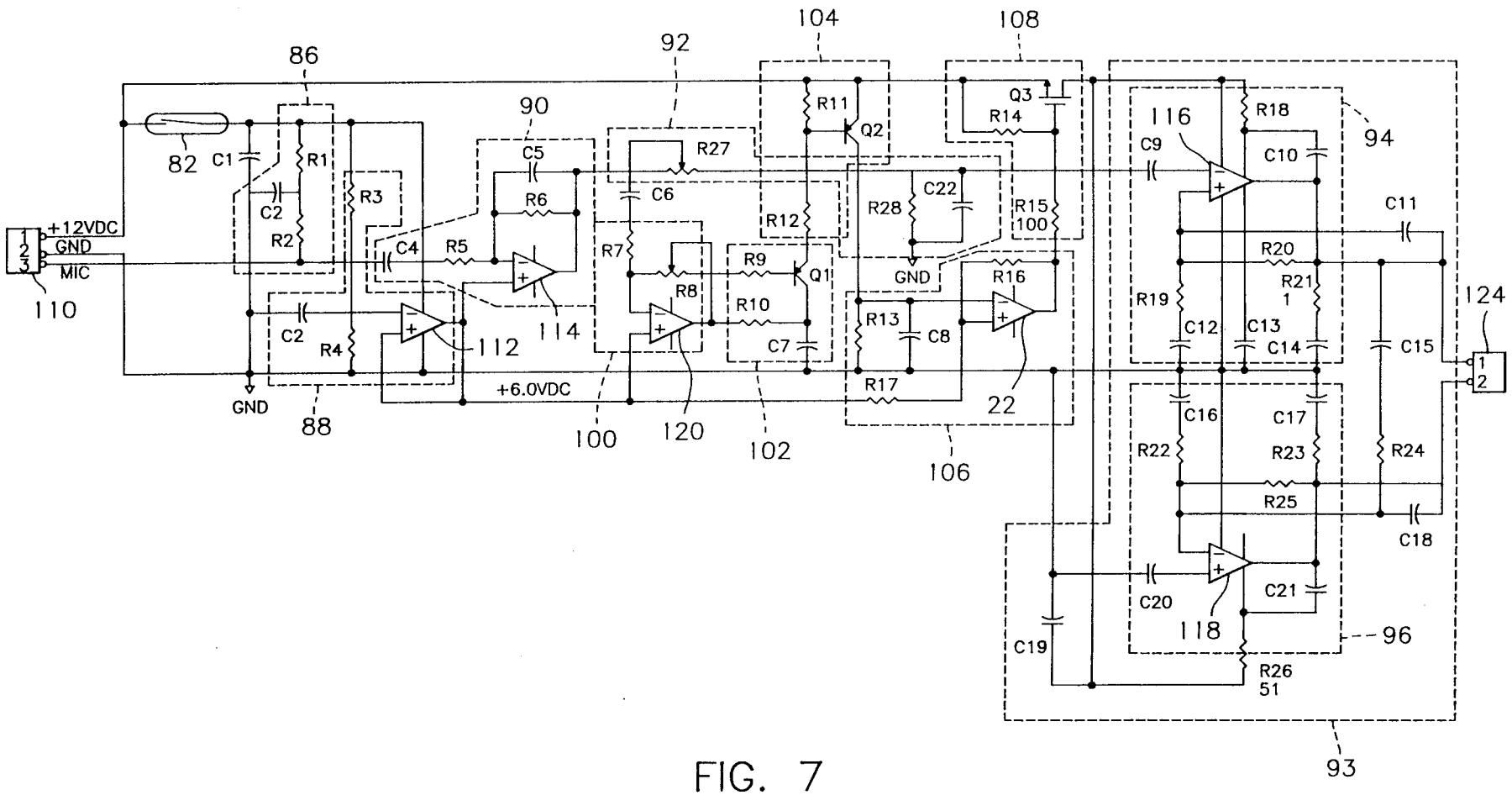
FIG. 7 is a detailed schematic diagram of the electronic circuitry shown in FIG. 6.

The circuitry disposed on the printed circuit board 16 is shown generally in FIGS. 6, and in greater detail in FIG. 7. The thrust of the circuitry is to amplify and transfer any voice sound spoken from within the protected mask environment to the external world with a greatly improved volume and intelligibility level over that of a voice diaphragm alone. The circuitry is operative to disconnect from the power supply if no voice is detected for a preset period of time. Normally the voice mask electronics module will remain fully powered so long as the switch ring 14 is in the proper ON position and the user actually is speaking into the unit, but if a pause in speech of 20 or more seconds is detected, the unit will automatically enter a power-down mode in order to conserve battery power. Once in power-down mode the unit will continue to monitor for speech and, the instant that the user begins to speak, will automatically bring the power amplifiers back on line.

The power supply or battery is shown at 80 in FIG. 6 as DC voltage source. The primary power supply to the internal electronics is controlled by the ring switch schematically shown at block 82, which as previously described, comprises an internal dry reed switch which is double protected from external contaminants and moisture due to its position and construction within the unit. When the magnet 15 is aligned with the reed switch, the reed switch closes its contacts to supply power to unit.

The electret microphone (34) is schematically shown at 84 and serves as the voice pickup microphone. The electret microphone is small in size, rugged, exhibits low noise, and is immune to vibration and to water and moisture effects. The microphone converts the incoming acoustical vibrations via a thin-film piezoelectric effect into a low amplitude AC signal which is then transferred to the internal electronics module for amplification, filtering, limiting, and rebroadcasting.

The electret microphone 84 is connected to a microphone power supply circuit 86 which limits and filters the low amplitude AC signal produced by the electret microphone 84. This circuit also sets the output impedance load for the electret microphone 84.

A stable voltage reference is provided at 88 to serve as a reference for the associated used throughout the analog circuitry.

The AC output of the microphone is applied to a bandpass amplifier 90 which amplifies the microphone output in a preset bandwidth primarily dedicated to voice. Once the incoming voice is filtered and amplified by the bandpass amplifier 90, the resulting signal is applied to a variable attenuator/filter 92. The attenuated and filtered signal is then amplified by an audio amplifying network 93 comprising audio power amplifiers 94 and 96, which are connected in a push-pull configuration to the audio loudspeaker 98.

In addition, power shut-down circuitry is provided to shut-down the associated electronics when no voice is detected for a period of time. Specifically, a threshold amplifier 100 is provided and connected to the output of the bandpass amplifier 90 and to the voltage reference circuit 88. The threshold amplifier 100 generates an amplified version of its input according to a preset ratio. A detector circuit 102 receives the output of the threshold amplifier and compares it with a floating DC reference. The result of this comparison is converted to voltage by the voltage translator 104 and fed to an analog timer 106. Absence of voice for a preset period of time set by the analog timer 106 causes a power switch 108 to disconnect the power amplifiers of the audio amplifying network 93 from the battery power supply.

FIG. 7 illustrates the circuitry shown in FIG. 6 in greater detail. A header 110 receives the power supply (12 V DC), a ground and the output from the microphone 84. Capacitor C1 is provided to connect the reed switch 82 to the microphone power supply circuit to filter out any DC components at the output of the reed switch 82. The microphone power supply circuit 86 comprises resistors R1 and R2 and capacitor C2 which form a power supply limiting and filtering circuit for the microphone and a pi network low pass filter with a cut-off frequency at 1.5 Hz. Resistor R2 sets the AC output impedance load for the electret microphone at 2.2 K ohms.

The voltage reference circuit 88 comprises an operational amplifier 112, resistors R3 and R4, and capacitor C3. Resistors R3 and R4 and capacitor C3 form a low pass pi network filter with a cut-off frequency at 1.6 Hz and simultaneously divides the power supply voltage by two. This voltage is applied to the input of the operational amplifier 112, which operates as a unity gain buffer/follower circuit. The follower acts to transfer the voltage reference at its input to its output while simultaneously converting the reference to a low impedance source. This low impedance voltage reference (hereinafter referred to as $V_{cc}/2$) is then used throughout the system for both analog AC references as well a timing level references.

The bandpass amplifier 90 comprises capacitors C4 and C5, resistors R5 and R6 and operational amplifier 114. The AC output of the microphone is applied to one side of the capacitor C4. The capacitor C4 serves as a DC blocking capacitor and, in conjunction with resistor R5, as a high pass filter with cut-off frequency at 338 Hz. The gain of the amplifier 90 is set by the R6:R5 ratio at 11 (20.82 dB). The other cut-off frequency at the high end is 2842 Hz, set by capacitor C5 and resistor R6.

The attenuator/filter 92 comprises resistors R27 and R28 and capacitor C22. The value of resistor R27 is adjusted to provide the necessary audio gain adjustments for audio amplitude trimming. The maximum attenuation possible with this configuration is −40.08 dB. Capacitor C22, together with resistor R28, forms a low pass filter with cut-off frequency at 3386 Hz.

The audio power amplifier network 93 is formed around amplifiers 116 and 118 which are connected in a push-pull or bridge tied load configuration. Such a configuration achieves the best possible power performance under low voltages. The overall gain of the amplifying network is set at 40.17 dB.

Amplifier 116 is a non-inverting gain block, the output of which directly drives one terminal of the loudspeaker 98. Capacitor C9 is a DC blocking capacitor which passes voice AC signal and allows DC re-referencing. This capacitor forms a high pass filtering network together with the 50K ohm input impedance of the amplifier 116, with a cut-off frequency at 318 Hz. Resistor R18 and capacitor C10 form a voltage bootstrap circuit which improves the rail-to-rail operation of the amplifier 116 for the low voltage battery driven circuit. The AC gain of the circuit block 94 associated with amplifier 116 is set by the R20:R19 ratio and is approximately 50. This gain is effectively doubled by the unity gain inversion action of amplifier 118. Resistor R19 and capacitor C12 form a DC blocking circuit having a pole at 169 Hz. Capacitor C11 and R20 set the high frequency limiting response of the amplifier at 33.863K Hz. Resistor R21 and C14 ensure stable amplifier output during high frequency operation or during transients.

Amplifier 118 is an inverting unity gain buffer, the output of which directly drives the other terminal of the loudspeaker 98. Capacitor C20 forms a DC blocking capacitor which allows referencing of the voice AC signal to ground for the inverting circuit. This capacitor, in conjunction with the 50K ohm input impedance of amplifier 118, forms a high pass filtering network with a cut-off frequency at 318 Hz. Resistor R26 and C21 form a voltage bootstrap circuit which allows improved rail-to-rail operation of the amplifier for low voltage battery driven circuits such as this one. The AC gain of the amplifier 118 circuit block 96 associated with amplifier 96 is set by the R24:R25 ratio and is approximately −1. Resistor R22 and capacitor C16 form both a high frequency bypass circuit and DC blocking circuit (effectively setting the DC gain of the amplifier at 1) which has a pole at 7958 Hz. Capacitor C18 and resistor R25 set the high frequency limiting response of the amplifier at 33.863K Hz. This pole is set this high in order to satisfy the amplifier high frequency stability specifications. Resistor R23 and capacitor C17 ensure stable amplifier output during high frequency operation or during transients.

The purpose of the threshold amplifier 100, detector 102, voltage translator 104, timer 106, and power switch 108 is to power down the power-hungry main amplifiers 116 and 118 during periods of quiescent operation (no speech), thus saving significant battery power.

The threshold amplifier 100 comprises amplifier 120 and further amplifies the voice signal according to the gain ratio of R8:R7 (typically −50) and is referenced to the voltage reference provided by the voltage reference circuit 88 supplied by amplifier 112 due to the DC blocking action of capacitor C6. Capacitor C6 and resistor R7 also form a high pass filter having a cut-off frequency at 159 Hz.

The threshold detector 102 comprises transistor Q1, capacitor C7, and resistors R9 and R10. These components form a floating threshold detector designed to detect the presence of voice signals which exceed a certain threshold. A floating DC reference against which this threshold is measured is formed by the action of resistor R10 and capacitor C7. The floating DC reference allows use of the detector under varying conditions of temperature, battery supply voltage fluctuations, and battery supply types.

Resistor R10 under quiescent operating conditions charges capacitor C7 up to the voltage existing at the output of amplifier 120 (normally Vcc/2) and holds it at that charged level. The charge time constant is set at about 1 second according to the ratio R10:C7, and the resultant DC reference which exists at the emitter of Q1 very gradually changes as compared with the AC signal which is output by amplifier 120 under normal circumstances.

If any portion of an AC signal present at the output of amplifier 120 exceeds 0.6 V DC (the base-emitter threshold of transistor Q1) above the reference voltage present on the emitter of transistor Q1, then transistor Q1 will turn on. The action of transistor Q1 turning on signifies that a portion of an AC signal exceeding the threshold formed by the transistor Q1 base/emitter junction (V(BE)+(Vcc/2)) has been detected which is indicative of the user speaking into the microphone of the unit.

The voltage translator 104 comprises resistors R11 and R12, which together with transistor Q2, form a voltage translation circuit which converts the Vcc/2 reference signal available at the output of transistor Q1 to a Vcc referenced signal for use by the timing capacitor C8. Resistor R12 serves as a base current limiting resistor and resistor R11 ensures that transistor Q2 remains fully off when not otherwise turned on by Q1. When transistor Q1 turns on, it pulls the base of transistor Q2 low toward Vcc/2, turning Q2 on. When transistor Q2 turns on, it will pull its collector high (toward Vcc) which is used to quickly charge the timing capacitor C8.

The analog timer comprises capacitor C8, resistors R13, R16 and R17 and the amplifier 122. Capacitor C8 and R13, together with transistor Q2, form an analog timing circuit with a charge-up time constant set by the ratio (R12/Hfe of Q2)*C8 and with a charge-down time constant set by R13*C8 (approximately 20 seconds).

When voice is detected by the threshold detector 102, transistor Q2 will turn on and quickly charge C8 toward Vcc. During quiescent periods (no voice detection) resistor R13 will discharge capacitor C8 slowly back to ground. The voltage present on capacitor C8 is applied to amplifier 122 and associated components which form an inverting Schmidt trigger comparator circuit. The analog reference voltage (Vcc/2) is used as the reference and is applied to amplifier 122 via resistor R17. Resistor R16 forms a positive feed-back DC path which provides a Schmidt trigger (or snap-action) function, ensuring that the output of amplifier 122 is always at either ground or Vcc.

When capacitor C8 is charged toward Vcc by transistor Q2 (when voice is detected), the comparator output will go low as the voltage passes Vcc/2 in a positive direction. During quiescent conditions, resistor R13 will slowly discharge capacitor C8 and the output of the amplifier 122 will go high when the timing voltage across capacitor C8 passes through Vcc/2 in a negative direction (correcting for the small DC offset provided by resistor R16).

The power switch 108 comprises transistor Q3 which forms a low impedance DC power supply switch through which the main power supply for the audio power amplifiers pass. During quiescent operation periods (no voice is detected), transistor Q3, which is a P-Channel MOSFET, will normally remain OFF (gate=Vcc) and no power will be made available to the power amplifiers. On the other hand, when voice is detected by the detection circuitry, the gate voltage will be driven toward ground by the amplifier 122 through resistor R15, turning on the MOSFET Q3 which then passes power to the audio power amplifiers 116 and 118. Resistors R14 and R15 allow one to tailor the voltage applied to the gate of transistor Q3 for best operation.

A header 124 is provided which connects the output of the audio power amplifier network 93 to the loudspeaker 98.

The loudspeaker is a 2.25 inch 8 ohm mylar cone speaker with a neoprene rubber seal (gasket). As aforementioned, the neoprene rubber seal and mylar cone allow the speaker to enjoy a relatively high degree of immunity to moisture and which will allow immersion into water-based decontamination solution.

The circuitry described above provides for excellent speech intelligibility. The over cut-off frequency is 500 Hz which facilitates crispness in the sound emitted by the loudspeaker. In addition, this cut-off frequency prevents the loudspeaker from reproducing low frequencies which may cause the speaker to slam the speaker cone against its extremes.

The following is lists the values for the electrical components shown in FIG. 7.

| | | | | | |
|---|---|---|---|---|---|
| R1 | 10 K | R16 | 10 M | C6 | 0.1 μF |
| R2 | 2.2 K | R17 | 1 M | C7 | 10 μF |
| R3 | 1 M | R18 | 51 | C8 | 10 μF |
| R4 | 1 M | R19 | 2 K | C9 | .01 μF |
| R5 | 10 K | R20 | 100 K | C10 | 47 μF |
| R6 | 100 K | R21 | 1 | C11 | 47 pF |
| R7 | 10 K | R22 | 2 K | C12 | 0.47 μF |
| R8 | 1 M | R23 | 1 | C13 | 47 μF |
| R9 | 100 K | R24 | 100 K | C14 | 0.1 μF |
| R10 | 100 K | R25 | 100 K | C15 | 0.1 μF |
| R11 | 1 M | C1 | 10 μF | C16 | 0.1 μF |
| R12 | 10 K | C2 | 47 μF | C17 | 0.1 μF |
| R13 | 2 M | C3 | 0.1 μF | C18 | 47 pF |
| R14 | 1 M | C4 | .047 μMF | C19 | 100 μF |
| R15 | 100 | C5 | 560 pF | | |

Figure 8:
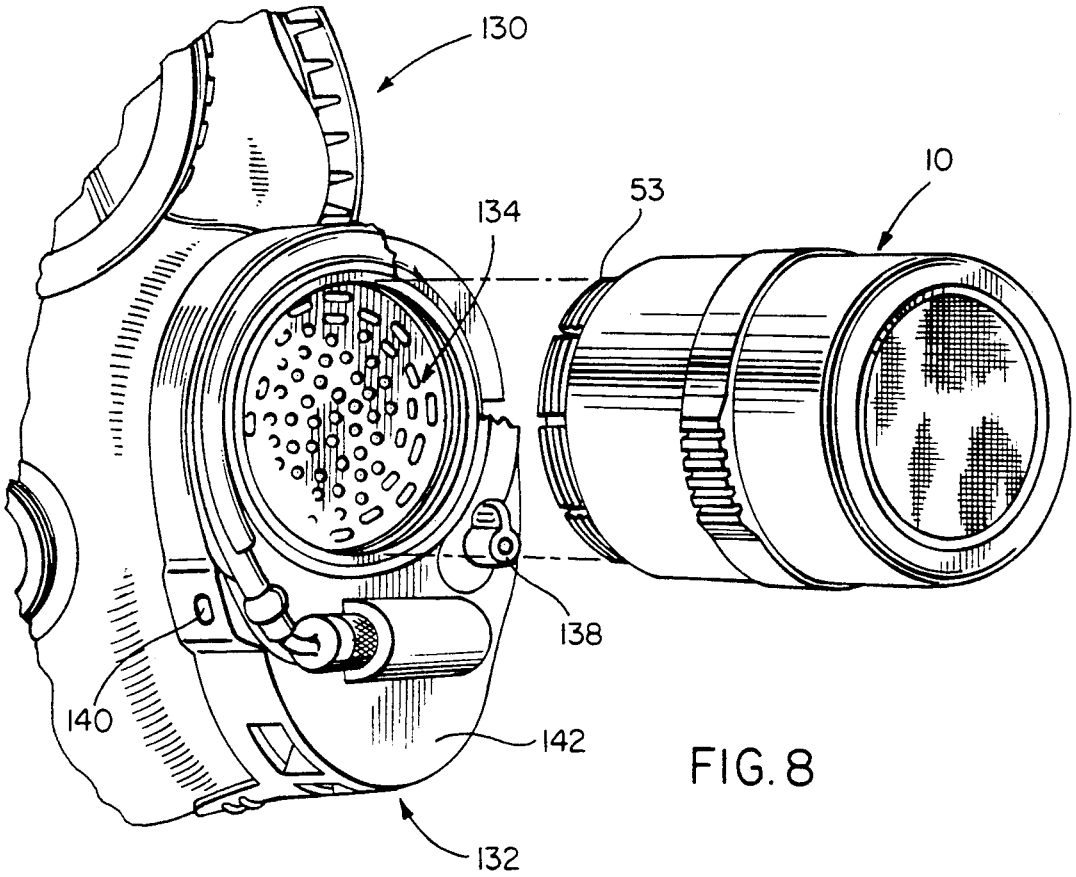
FIG. 8 is a perspective view illustrating the attachment of the amplifier unit to a M-17 gas mask.
Figure 9:
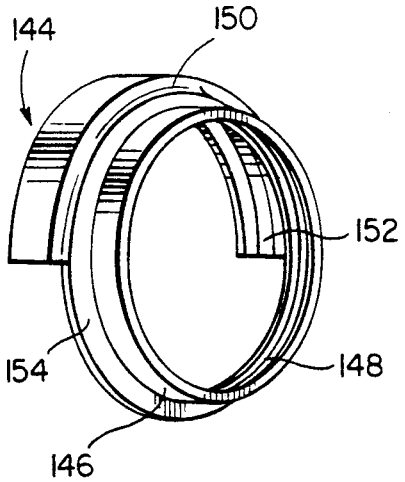
FIG. 9 is a perspective view of an adaptor piece which fits to the M-17 gas mask to removable attache the amplifier unit to the gas mask.
Figure 10:
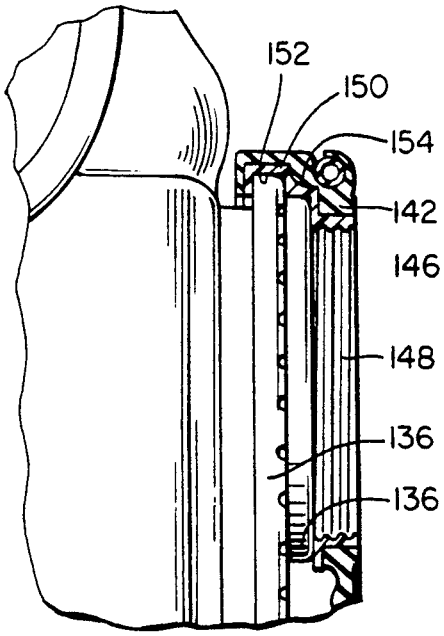
FIG. 10 is a cross-sectional view taken through line 9—9 of FIG. 7 and illustrating the adaptor piece in position on the gas mask.

Turning now to FIGS. 8–10, the attachment of the gas mask amplifier unit 10 to a M-17 gas mask shown generally at 130, used by the United States armed forces, will now be described. It is a primary goal of the present invention to provide an attachment arrangement which does not affect the structural and functional integrity of the host gas mask.

A brief description of the pertinent structural features of the M-17 130 mask follows first. The M-17 gas mask comprises a nose piece section 132 having a mechanical emitter 134 supported by a face plate 136 which seals the inside of the mask from the exterior environment. The face plate 136 also supports a valve member 138 and has pins 140 on both sides thereof. A rubber cap member 142 removably fits over the face plate 136 and has holes for receiving the pins 140. The rubber cap member 142 surrounds but does not cover the mechanical emitter 134. Other structural features of the mask that are illustrated, and particularly of the rubber cap member, are not critical to understanding the present invention, and thus will not be described.

The amplifier unit 10 will not attach directly to an M-17 gas mask without additional hardware. In this regard, an adaptor has been designed to attach to the face plate 136 and circumscribe the mechanical emitter 134. The adaptor is shown at 144 in FIG. 9 and comprises a ring portion 146 having internal threads 148 to mate with the external threads 53 on the ring member 49 of the base 42. In addition, the adaptor 144 comprises a clip portion 150 which is a semi-circular piece defining a semi-circular slot 152 sized and shaped to receive the rim of the face plate 136 of the mask and to removably snap into place firmly on the face plate 136 so that the ring portion 146 circumscribes the mechanical emitter 134 of the gas mask 130. To this end, the adaptor 144 further comprises a shelf portion 154 sized and shaped to fit over a rim of the mechanical emitter 134 so as to properly position the ring portion 146 in a snug fitting relationship over the mechanical emitter, as shown in FIG. 10.

The adaptor 144 is mounted on the face plate 136 with the rubber cap member 142 removed. Once the adaptor 144 is in position, the rubber cap member 142 is attached to the mask over the adaptor, fitting to the mask as it normally would without the adaptor 144. The amplifier unit 10 is then inserted and screwed into the adaptor 144 so that the threads 53 of the ring member 49 mate with the threads 146 of the adaptor. Thus, the amplifier unit 10 attaches to the M-17 gas mask without affecting the structure of function of the mask. The voice microphone of the amplifier unit 10 picks up the sounds emitted by the mechanical emitter 134 of the gas mask. All components provided for voice amplification resides completely outside and apart from the host mask equipment. The amplifier unit 10 can be removed and the mask can be worn as designed with the mechanical emitter being employed for voice communication.

Figure 11:
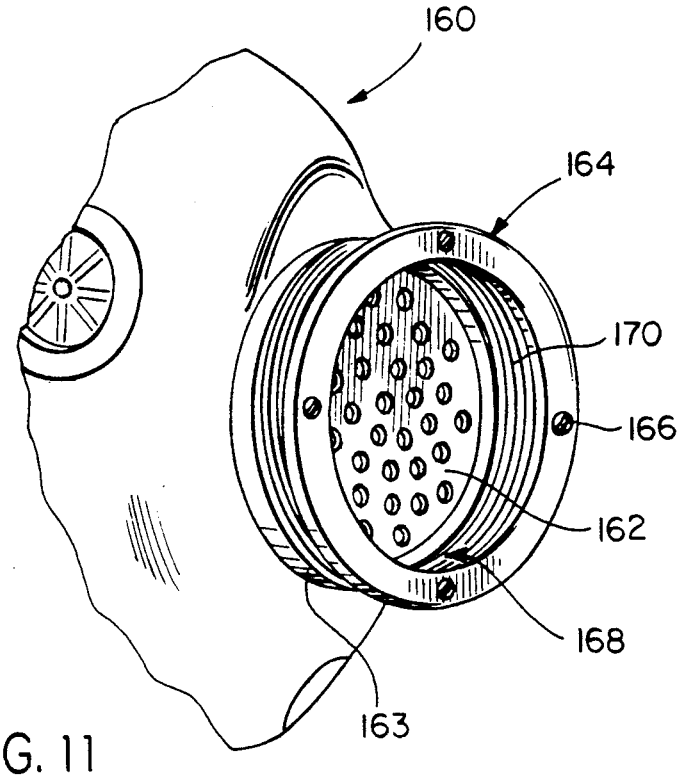
FIG. 11 is a perspective view of a nose piece portion of a M-40 gas mask and illustrating a retainer ring incorporated as part of the gas mask for securing a mechanical emitter to the gas mask.
Figure 12:
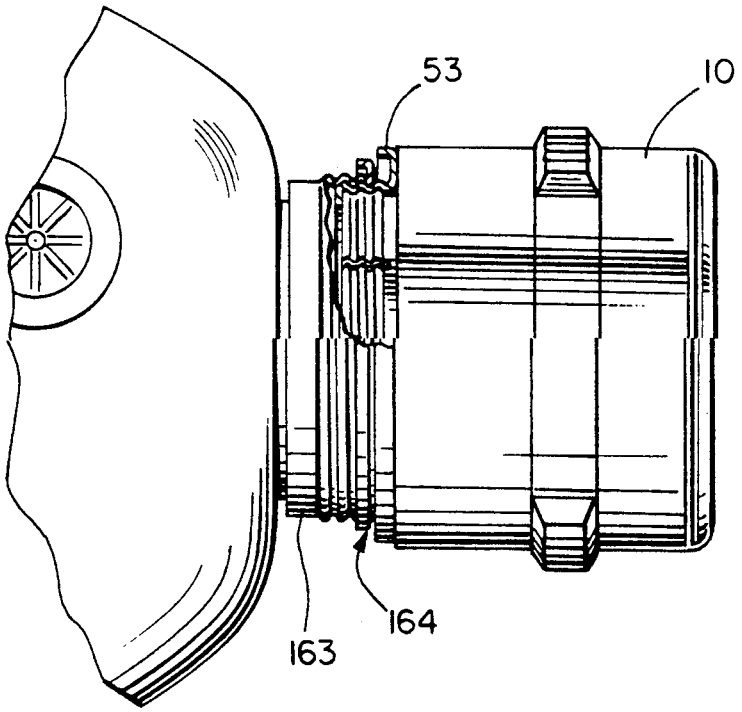
FIG. 12 is a side view and part cut away view illustrating the attachment of the amplifier unit to the M-40 gas mask.

FIGS. 11 and 12 illustrate attachment of the amplifier unit 10 to a M-40 and M-CU/2P gas mask, soon to be issued to the United States armed forces. The nose piece portion of the M-40 and M-CU/2P gas mask is shown at 160 in FIG. 12. In this gas mask, the mechanical emitter 162 is held in place on the gas mask by a retaining ring 164 which screws into support ring 163. The support ring 163 is permanently attached and sealed to the rubber body of the gas mask. The mechanical emitter sits in the support ring 163 and the retaining ring 164 seals the mechanical emitter 162 between it and the support ring 163. This is done during manufacture of the mask by rotating the retaining ring 164 into the support ring 163 using a tool which fits the holes 166 on the face of a rim of the retaining ring 164 to apply torque thereto. The retaining ring 164 has a short cylinder portion 168 which includes inner threads 170. The threads 53 on the ring member 49 of the base 42 are sized to mate with the threads 170. Therefore, the amplifier unit 10 screws into the retaining ring 164 as shown in FIG. 10, without any additional hardware. The voice sounds emitted by the mechanical emitter 162 are picked up by the voice microphone in amplifier unit 10.

Furthermore, it is important to ensure that attachment and removal of the amplifier unit 10 from the gas mask 160 does not harm the seal established by the retaining ring 164. The retaining ring 164 is secured to the gas mask at a nominal torque (50 inch pounds) set during manufacture. If the amplifier unit 10 were to be rotated tightly against the retaining ring 164, the retaining ring could bind to the amplifier unit 10 so tightly that subsequent removal of the unit 10 would also pull back (or unscrew) the retaining ring 164 from the support ring 163. To prevent this from occurring, the size of the threads 53 of the amplifier unit 10 are made slightly smaller than the size of the threads 170. As a result, if the unit 10 is screwed into the retaining ring 164 too tightly, the threads 53 will "pop" before tightening to the point of severe friction engagement with the retaining ring 164. Furthermore, the slots 51 in the threads 53 of the unit 10 provide a certain amount of spring to facilitate the popping action. Also, the slots 51 serve as a mechanical wipe to remove dirt within the threads of the retaining ring or in the threads of the unit 10 so that dirt is collected and trapped in the slots, permitting successful attachment to the gas mask, notwithstanding the presence of dirt.

While the foregoing description relating to the attachment of the amplifier unit 10 to a gas mask has been described with respect to a M-17 and a M-40 (and M-CU/2P) gas mask, it is to be understood that the amplifier unit 10 can attach to other masks of similar structure in the same manner. Furthermore, it is envisioned that the unit 10 is attachable to other types of gas masks not disclosed herein either directly or through special adaptors.

The above description is intended by way of example only and is not intended to limit the present invention in any way except as set forth in the following claims.

I claim:

1. A device for removable attachment to a gas mask for amplifying voice sound comprising:

a cylindrical barrel member having first and second open ends;

a battery supply casing for receiving at least one battery and having output terminals, said battery supply casing being removably mounted in said cylindrical barrel member;

a voice microphone mounted in said barrel member for picking up voice sound emitted by a wearer of a gas mask;

a printed circuit board comprising electrical circuitry for amplifying the voice sound detected by the voice microphone, said printed circuit board comprising connection pins which electrically connect with the output terminals of said battery supply casing;

an insulated electrical conductor connecting the voice microphone with said printed circuit board;

a power switch disposed inside said barrel member to connect and disconnect the electrical circuitry to and from said at least one battery;

a switching member comprising a ring which slides onto and rotates around the exterior of said barrel member between first and second positions for actuating the power switch to cause the power switch to connect and disconnect the electrical circuitry to and from the at least one battery;

loudspeaker means mounted inside said barrel member and electrically connected to said printed circuit board so as to emit sound outward through one of said first and second open ends of said barrel member;

first end cap means removably attachable to said barrel member at said first open end thereof;

second end cap means removably attached to said barrel member at said second open end thereof; and said first and second end cap means sealing the respective interior portions of the barrel member from water and from chemical or biological agents.

2. The device of claim 1, and wherein said power switch comprises a reed switch for connecting the electrical circuitry to said at least one battery when closed and disconnecting the electrical circuitry from said at least one battery when open, said switching member further comprising:

a permanent bar magnet attached in an interior surface of said ring facing the exterior of the barrel member, said permanent bar magnet closing said reed switch when said ring is in said first position at which the permanent bar magnet is position on the exterior of the barrel member in alignment with said reed switch for connecting the electrical circuitry to said at least one battery, and opening said reed switch when said ring is not in said first position.

3. A device for attachment to a gas mask for amplifying voice sound comprising:

a cylindrical barrel member having first and second open ends providing access to first and second isolated compartments separated by a retaining wall traversing the interior of said barrel member, respectively, said first compartment comprising a donut-shaped well circumscribing a cylindrical passageway, said retaining wall comprising holes therethrough connecting the first and second compartments;

a battery casing for receiving at least one battery and having output terminals, said battery casing being donut-shaped and being removably mounted in the first compartment of said barrel member;

a voice microphone mounted in the cylindrical passageway of the first compartment of said barrel member, said voice microphone for picking up voice sound emitted by a wearer of a gas mask and converting said voice sound to electrical signals;

a printed circuit board comprising electrical circuitry for amplifying the voice sound detected by the voice microphone mounted in said second compartment of said barrel member:

connection pins connected to said printed circuit board and passing through the holes in the retaining wall to electrically connect with the output terminals of the battery casing;

an insulated electrical conductor connected to said voice microphone and passing through one of said holes in the retaining wall for connecting with said printed circuit board;

a reed switch disposed on said printed circuit board inside said barrel member capable of assuming a closed position to connect the electrical circuitry to said at least one battery and an open position for disconnecting the electrical circuitry from said at least one battery;

a ring member positioned around the exterior of said barrel member and rotatable about said barrel member a fraction of a full circle between ON and OFF positions, a permanent bar magnet being embedded in an inner surface of the ring member for cooperating with the reed switch so that when the ring member is rotated to said ON position, the permanent bar magnet is aligned over the reed switch on the exterior of the barrel causing the reed switch to close and thus connect the electrical circuitry to and said at least one battery, and when the ring member is rotated to said OFF position where the permanent bar magnet is not aligned over the reed switch on the exterior of the barrel member, the reed switch remains open disconnecting the electrical circuitry from said at least one battery;

loudspeaker means mounted inside the second compartment of said barrel member and electrically connected to said printed circuit board so as to emit sound outward through one of said first and second open ends of said barrel member;

sealing means disposed adjacent said loudspeaker means to seal the second compartment of said barrel member from water and chemical or biological agents;

filter means positioned in said second compartment of said barrel member adjacent to said loudspeaker means to prevent small dust and sand particles from entering said second compartment of said barrel member;

first end cap means removably attachable at said first open end of said barrel over the filter means; and second end cap means removably attachable to said barrel member at said second open end thereof to seal the first compartment of said barrel member from water and chemical or biological agents.

4. The device of claim 3, wherein a groove is provided on an exterior surface of said battery casing and a projection is provided on a surface in the first compartment of said barrel member so that said battery casing fits into the first compartment of said barrel member in only one orientation so that the battery terminals of said battery casing contact the connection pins.

5. The device of claim 3, wherein said electrical circuitry comprises:

filtering means connected to said microphone for filtering the electrical signals produced by said microphone to a predetermined bandwidth to generate filtered electrical signals representing said voice sounds which are; and amplifying means connected to said filtering means for amplifying the filtered electrical signals and supplying said filtered electrical signals to said loudspeaker means.

6. The device of claim 5, wherein said filtering means filters out low frequencies above a certain predetermined cut-off frequency while permitting higher frequencies to pass to said loudspeaker means so that said loudspeaker emits intelligible voice sound.

7. The device of claim 5, wherein said amplifying means comprises first and second amplifiers connected to said loudspeaker means in a push-pull configuration.

8. The device of claim 5, wherein said electrical circuitry further comprises power shut-down means for disconnecting said battery supply means from said amplifying means in response to the absence of voice sounds for a predetermined time interval.

9. The device of claim 8, wherein said power shut-down means comprises:

means for detecting the level of sound picked up by said microphone;

means for comparing the level of sound detected with a preset threshold value;

timing means for initiating said time interval of said predetermined duration upon said means for comparing determining that the level of sound detected is less than said preset threshold value; and power switch means connected to said timing means for disconnecting the battery supply from said amplifying means upon said the level of sound detected by said means for detecting not exceeding said preset threshold value during said timing interval.

10. A device for removably attaching to a gas mask for amplifying sound emitted by a wearer of the gas mask comprising:

housing means sealed from the external environment and containing:

microphone means for detecting voice sound and converting the voice sound to an electrical signal representative thereof;

electronic circuitry including amplifying means connected to said microphone means for amplifying said electrical signal;

loudspeaker means connected to said amplifying means for converting the amplified electrical signal to sound;

a battery pack removably mounted in said housing means for providing a source of electrical energy to power the amplifying means;

power switch means connected between said battery pack and said amplifying means for connecting and disconnecting the electrical energy from said amplifying means;

means attached to said housing means for removably attaching said housing to a gas mask; and switch actuation means comprising a ring which slides onto and rotates around the exterior of said housing between first and second positions for controlling said power switch means to connect or disconnect said electrical energy from the amplifying means.

11. The device of claim 10, and further comprising connection pins for connecting the battery pack with the electronic circuitry and guide means in said housing means, and wherein the battery pack comprises output terminals, said battery pack having alignment means to mate with the guide means of said housing means so that said battery pack mounts in said housing in a predetermined orientation so that said output terminals make electrical contact with the connection pins.

12. In combination, a gas mask having a mechanical emitter and a retaining ring securing and sealing said mechanical emitter to said gas mask, said retaining ring having internal threads, an electrical amplifier unit having microphone means for detecting sound emitted by said mechanical emitter and converting the sound to electrical signals, amplifying means for amplifying the electrical signals, and loudspeaker means for converting the amplified electrical signals to sound emitted externally of the gas mask, housing means for containing said microphone means, amplifying means and loudspeaker means, attachment means for attaching said housing to said gas mask comprising external threads which mate with the internal threads of the retaining ring the combination further comprising means formed as part of said attachment means for preventing said attachment means from being overtightened in said retaining ring, where said means formed as part of said attachment means comprises slots formed transverse to said threads of said attachment means.

13. The combination of claim 12, wherein said means for preventing overtightening comprises the size of the threads of the attachment means being slightly smaller than the size of the threads of the retaining ring so that said attachment means cannot be tightened past a predetermined torque in said retaining ring.

* * * * *